US007707754B2

(12) United States Patent
Congdon

(10) Patent No.: US 7,707,754 B2
(45) Date of Patent: May 4, 2010

(54) AUGER LOADING APPARATUS AND MACHINE WITH SAME

(75) Inventor: Thomas M. Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 515 days.

(21) Appl. No.: 11/438,020

(22) Filed: May 19, 2006

(65) Prior Publication Data

US 2007/0267225 A1 Nov. 22, 2007

(51) Int. Cl.
*B65G 33/00* (2006.01)
*E02F 3/06* (2006.01)

(52) U.S. Cl. ..... 37/420; 37/431; 37/419

(58) Field of Classification Search ..... 37/419, 37/420, 431, 304, 262, 260, 142.5, 427, 416; 241/24.1, 9

See application file for complete search history.

(56) References Cited

U.S. PATENT DOCUMENTS 1,477,212 A * 12/1923 Eckertz ..... 37/304
2,411,280 A * 11/1946 Lichtenberg et al. ..... 37/412
2,602,388 A * 7/1952 Elliott et al. ..... 47/1.42
3,431,659 A * 3/1969 Eiger ..... 37/420
3,431,663 A * 3/1969 Eiger ..... 37/431
3,474,548 A 10/1969 Miller
3,533,174 A 10/1970 Carston
3,603,363 A * 9/1971 Frankshtein ..... 99/637
3,653,132 A 4/1972 Campbell et al.
3,731,975 A * 5/1973 Lindelof ..... 299/8
3,738,028 A * 6/1973 Reinhardt ..... 37/416
3,857,190 A * 12/1974 Gee et al. ..... 37/420
3,859,741 A * 1/1975 Reinhardt ..... 37/420
3,863,367 A 2/1975 Gee et al.
3,865,727 A * 2/1975 Broling et al. ..... 210/162
3,994,303 A * 11/1976 Rowland-Hill ..... 460/70
4,104,048 A 8/1978 Urbanczyk
4,167,825 A 9/1979 Gee et al.
4,197,049 A * 4/1980 Stedman et al. ..... 414/493
4,366,635 A * 1/1983 Joyce, Jr. ..... 37/416
4,575,959 A 3/1986 Gee
4,864,748 A * 9/1989 Boyer ..... 37/142.5
5,199,196 A 4/1993 Straley
5,232,305 A 8/1993 Bassett et al.
5,485,964 A * 1/1996 Booth et al. ..... 241/27
5,507,396 A * 4/1996 Hauch ..... 209/399
5,678,639 A 10/1997 Golden (Continued)

FOREIGN PATENT DOCUMENTS

JP 57172042 A * 10/1982

(Continued)

*Primary Examiner*—Thomas A Beach
(74) *Attorney, Agent, or Firm*—Liell & McNeil

(57) ABSTRACT

A machine, such as a scraper machine, includes a bowl, a cutter and a loading apparatus coupled with the cutter and including a chute having a first end disposed outside the bowl, and an auger positioned at least partially within the chute. The auger includes at least one auger, and is configured to move work material between the first and second ends of the chute. A method of operating the scraper machine includes capturing work material at least in part by moving the cutting edge of the scraper machine through the work material, and conveying work material from the chute into the bowl at least-in part by rotating the auger.

19 Claims, 3 Drawing Sheets

U.S. PATENT DOCUMENTS 5,720,440 A * 2/1998 Bonner et al. ..... 241/101.761
5,864,971 A * 2/1999 Jones ..... 37/410
6,135,290 A * 10/2000 Heiple ..... 209/421
6,152,306 A * 11/2000 Miller ..... 209/3
6,325,311 B1 12/2001 Preisser
6,336,068 B1 1/2002 Lawson et al.
6,422,789 B1 7/2002 Brewer
6,481,925 B1 11/2002 Olson
2002/0092799 A1* 7/2002 Storruste ..... 209/460
2006/0266676 A1* 11/2006 Bossen ..... 209/293

FOREIGN PATENT DOCUMENTS

SU 770567 * 10/1980

* cited by examiner

AUGER LOADING APPARATUS AND MACHINE WITH SAME

TECHNICAL FIELD

The present disclosure relates generally to a loading apparatus for a machine such as a scraper, and relates more particularly to a machine such as a scraper having an auger loading apparatus.

BACKGROUND

A wide variety of building and similar projects require preparatory work such as leveling, grading and filling of underlying soil, gravel or other materials. Highway and building construction, for example, typically requires that a prepared bed of compacted work material be provided upon which pavement, concrete, etc. is to be laid. In some instances, material fill for such purposes must be brought to the work site from another location. In others, material must be removed or redistributed. Foundations for buildings, dams, airports, factories and other construction projects generally present similar issues relating to elevation profile, slope, proper work material type, etc. Virtually all civil, environmental and other construction endeavors require at least some work material transport, and it will thus be readily apparent that the capacity to move relatively large quantities of material in an efficient manner may be paramount for the success of many public and private works projects.

To move relatively large volumes of material, construction contractors often utilize machines known as "scrapers" to remove material from one location and transport it to another. The term "scraper" generally refers to the ability of the machine to remove an overlying layer of work material from a work surface. Typical machines employ a scraper blade or cutting edge which may be moved through work material beneath the machine to remove a top layer of material. The removed material is placed into a "bowl" of the scraper, then transported to a different work site or different area of a work site for deposition. Efficient loading and unloading of the bowl in scraper machines has long presented an engineering challenge.

Certain scraper machines, known in the art as open bowl scrapers, rely upon forward motion of the machine to urge work material removed with the scraper blade backward and upward into the bowl. This approach generally requires a relatively large and heavy machine to provide sufficient power for driving the machine, removing material, and filling the bowl of the scraper. The challenge is compounded by traction losses of the machine during such operation. In some instances, separate tractor machines are used to push or pull self-propelled and other types of scrapers to enhance their ability to load a desired volume of work material.

Engineers have developed certain strategies addressing the loading and unloading challenges experienced with traditional open bowl scrapers. In one design, an elevator apparatus having paddles is used to lift work material from the vicinity of the scraper blade upward, thenceforth dumping the material into the bowl. Elevator designs have met with significant success, however, the relatively large number of moving parts and overall complexity of the apparatus tends to result in high wear and significant maintenance issues. Elevator scrapers also tend to generate significant dust.

Another strategy employs one or more augers within the scraper bowl to distribute the work material after it enters the bowl in a more even fashion than that achieved with a conventional open bowl design. In such bowl and auger systems, rotation of a load-distributing auger can lift work material within the bowl and urge work material toward the sides of the bowl such that the scraper machine may more easily push additional work material into the bowl via its forward travel. While systems employing load-distributing augers have various advantages, including some conditioning and mixing of the work material, the auger tends to take up significant space within the volume of the bowl, limiting the carrying capacity of a scraper machine of a given size. Moreover, ejection of material from the bowl tends to be problematic as it must generally be moved around the auger. The ejector system itself can occupy a significant amount of bowl volume.

One example of a scraper machine having a load distributing auger is known from U.S. Pat. No. 3,533,174 to Carston. In Carston's design, an auger is positioned within the bowl of a scraper machine at a generally vertical orientation. The auger receives loosened material within the bowl from a cutting blade as the machine is moved forward. While Carston's strategy, provides certain advantages over open bowl scrapers, the design is subject to the same limitations mentioned above with respect to the bowl capacity. In other words, Carston' auger takes up a substantial amount of bowl volume that might otherwise be available for carrying work material. Thus, certain of Carston's potential advantages are at least somewhat overshadowed by the loss in work efficiency. Moreover, because of the auger's position, the machine still relies largely upon forward travel to push material into the bowl.

The present disclosure is directed to one or more of the problems or shortcomings set forth above.

SUMMARY OF THE INVENTION

In one aspect, the present disclosure provides a machine having a bowl mounted to a frame which defines a load volume. The machine further includes a cutter coupled with the frame and having a cutting edge, and a loading apparatus coupled with the cutter. The loading apparatus includes a chute with a first end disposed outside of the bowl and a second end. The loading apparatus further includes an auger disposed at least partially within the chute, and the auger is configured to move work material between the first and second ends of the chute.

In another aspect, the present disclosure provides a loading apparatus for a scraper machine. The loading apparatus includes at least one auger having an axis of rotation, a loading end and a second end opposite the loading end. The at least one auger defines a length dimension aligned with the axis of rotation that extends between the loading end and the second end. The loading apparatus further includes a chute that includes a material feed opening at a first position relative to the length dimension of the at least one auger, and includes at least one material discharge opening separate from the material feed opening and disposed at a second position relative to the length dimension which is different from the first position. The at least one auger is configured to move work material between the material feed opening and the discharge opening in a feed direction aligned generally with the axis of rotation of the at least one feed auger.

In still another aspect, the present disclosure provides a method of operating a scraper machine that includes a step of capturing work material at least in part via a step of moving a cutting edge of the scraper machine through the work material. The method further includes a step of moving work material into a chute of the scraper machine at least in part via the moving step, and a step of conveying work material from the guide chute to a bowl at least in part by rotating an auger disposed at least partially within the chute.

DETAILED DESCRIPTION

Figure 1:
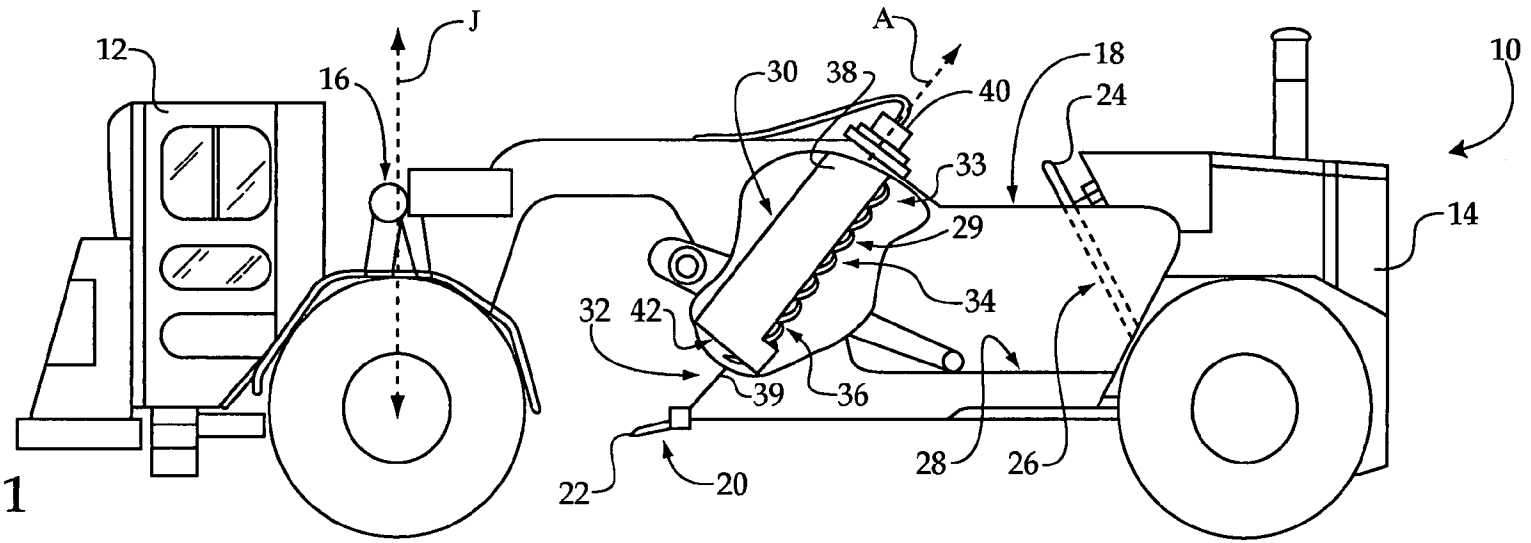
FIG. 1 is a partially sectioned side view of a scraper machine according to one embodiment of the present disclosure.

Referring to FIG. 1, there is shown a machine 10 according to one embodiment of the present disclosure 10. Machine 10 may be a self-propelled machine such as a self-propelled scraper machine, or it may be a tow-behind or pushed machine. Machine 10 may include a front frame unit 12 and a back frame unit 14 configured to articulate about an articulation axis J at an articulation joint 26. Non-articulated configurations are also contemplated herein, however. Machine 10 may further include a cutter 20 coupled to back frame unit 14, for example, and including a cutting edge 22. A bowl 18 may be mounted to back frame unit 14. Work material that is captured at least in part by moving cutter 20 through the work material may be stored for transport and eventual deposition into bowl 18. A loading apparatus 30, which may be positioned partially or entirely outside of bowl 18, may also be mounted to back frame unit 14 and coupled with cutter 20 for loading work material into and out of bowl 18.

Figure 2:
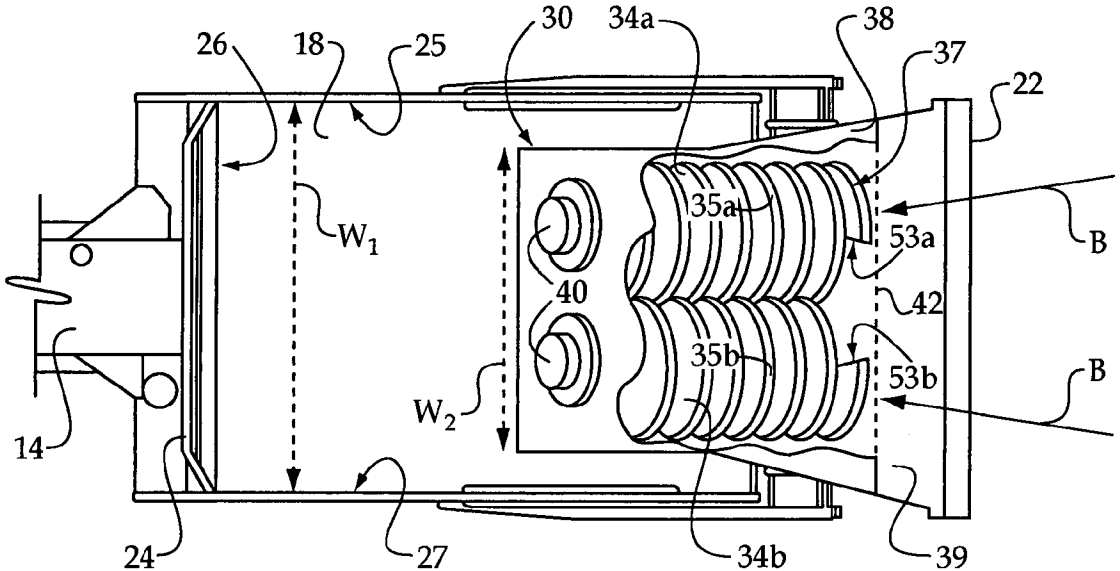
FIG. 2 is a top view of a portion of the scraper machine of FIG. 2.

Referring also to FIG. 2, bowl 18 may include a back side 26, for example, defined by a movable material ejector assembly 24, and a front side 29 which may be defined at least in part by loading apparatus 30, as further described herein. Bowl 18 may further include first and second sides 25 and 27, together with front side 29 and back side 26 defining a bowl load volume. Loading apparatus 30 may be configured to move work material into and out of bowl 18 for both loading and unloading of bowl 18.

Loading apparatus 30 may include a chute 38 having a first end 32 positioned outside of bowl 18, and a second end 33 through which work material may be conveyed during loading and/or unloading bowl 18. Chute 30 may further include an apron 39 extending from a material feed opening 42 outwardly toward cutter 20. Thus, work material removed from a work surface by cutter 20 may be guided via apron 39 toward and into material feed opening 42, and thenceforth discharged out of a material discharge opening 36 into bowl 18.

Loading apparatus 30 may still further include at least one auger 34 having an axis of rotation A. The at least one auger 34 is configured to feed work material in a feed direction between first and second ends 32 and 33 of chute 38. The at least one auger 34 may include first and second augers 34*a* and be 34*b* positioned in parallel. In one embodiment, augers 34*a* and 34*b* may comprise counter-rotating augers having blades 35*a* and 35*b* with overlapping peripheries. The augers are positioned in parallel, and configured to feed work material through chute 38 during either loading or unloading of bowl 18. An approximate feed direction for loading is shown via arrows B in FIG. 2. Unloading may take place generally in a reverse feed direction. Bowl 18 may further define a width $W_1$ extending between sides 25 and 27, chute 38 may define an internal width $W_2$, which is less than width $W_1$ but greater than about half of width $W_1$. Augers 34*a* and 34*b* may, for example, be driven by bi-directional hydraulic motors 40, but could be driven by some other means such as an internal combustion engine (not shown) in certain embodiments.

Figure 3:
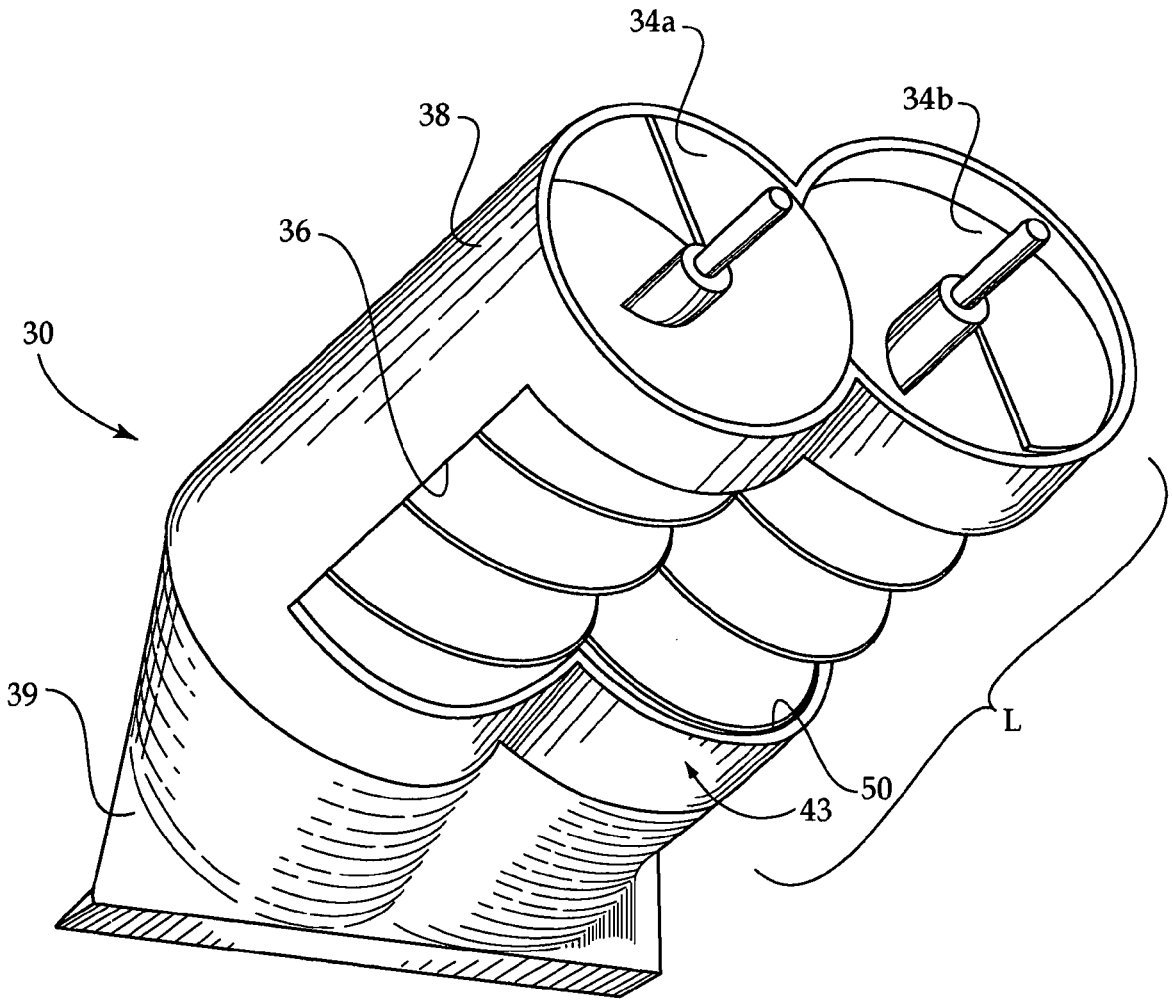
FIG. 3 is a bottom perspective view of a loading apparatus suitable for use with the scraper machine of FIG. 1.

Turning to FIG. 3, there is shown a back view in perspective of loading apparatus 30. Chute 38 of loading apparatus 30 may include a floor 43 wherein material discharge opening 36 is disposed. In certain embodiments, floor 43 and material discharge opening 36 may define front side 29 of bowl 18. During loading or unloading of bowl 18, material may be transferred through chute 38 either into or out of material discharge opening 36, and either into or out of bowl 18. Unloading of bowl 18 with augers 34*a* and 34*b* may be assisted by actuating ejector apparatus 24. Chute 38 may further include inner peripheral walls 50, for example, curving inner peripheral walls, extending at least partially about augers 34*a* and 34*b*, and further extending for at least a portion of a length dimension L defined by augers 34*a* and 34*b*. Inner peripheral walls 50 may define the internal width $W_2$ of chute 38, illustrated in FIG. 2.

Figure 4:
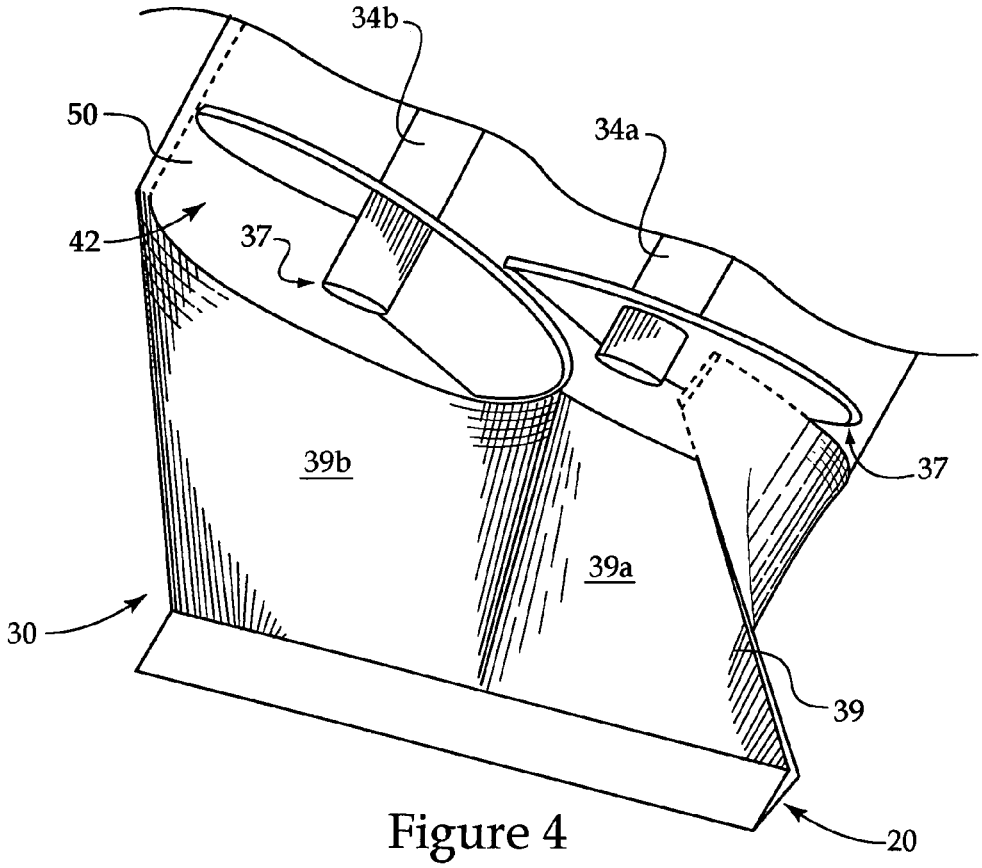
FIG. 4 is a partial front perspective view of the loading apparatus shown in FIG. 3.

Referring also to FIG. 4, there is shown a front view of a portion of loading apparatus 30 wherein first ends 37 of augers 34*a* and 34*b*, which may be understood as loading ends, are shown disposed hear material feed opening 42. It should be appreciated that the loading ends 37 of augers 34*a* and 34*b* may be positioned differently relative to material feed opening 42 from the illustrated configuration, for example, extending outwardly therefrom toward cutter 22. It may also be noted from FIG. 4 that curving inner peripheral walls 50 may connect with apron 39 approximately at material feed opening 42. Apron 39 may also include at least one concave portion comprising, for example, first and second curving surfaces 39*a* and 39*b* configured to guide work material from cutter 20 toward material feed opening 42. In other embodiments, however, apron 39 might comprise a flat panel, for example including sidewalls to assist in guiding work material from cutter 20 toward material feed opening 42. In still further embodiments, rather than including an apron for guiding material toward material feed opening 42, an apron might be omitted from the design, and augers 34*a* and 34*b* positioned relatively closer to cutter 20.

Figure 5:
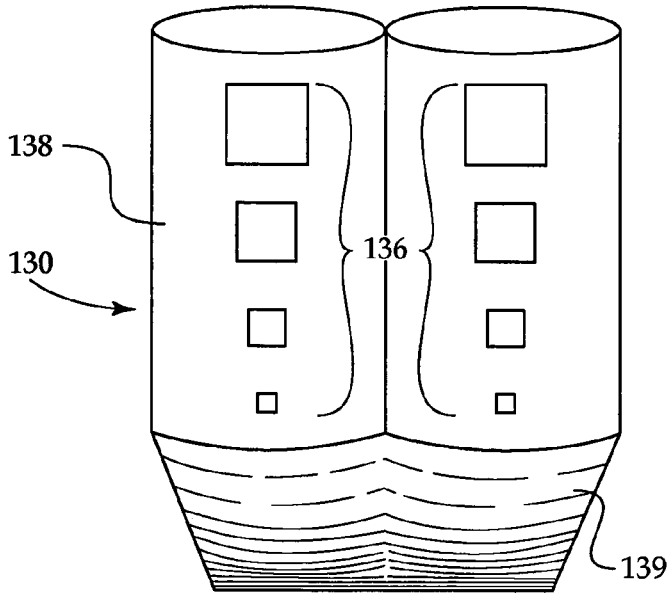
FIG. 5 is a back view of a portion of a loading apparatus according to another embodiment of the present disclosure.

In another embodiment of a loading apparatus 130, shown schematically in FIG. 5, a plurality of differently sized material discharge openings 136 may be provided in a chute 138. In the illustrated embodiment, material discharge openings 136 are relatively smaller closer to an apron 139 than material discharge openings 136 located relatively further from apron 139. Loading apparatus 138 may be suitable for use where sorting of work material during loading or unloading from a bowl of a scraper machine such as machine 10 is desired. Operation of loading apparatus 138 may be similar to that described herein with regard to the foregoing embodiments, however, work material of certain particle sizes may be fed into, and discharged, disproportionately among the different sized discharge openings of chute 138. For example, during loading of a bowl such as bowl 18, relatively larger sized particles, such as relatively large rocks, may be conveyed toward the discharge openings 136 that are spaced relatively further from apron 139, whereas relatively smaller sized particles may be discharged through the discharge openings relatively closer to apron 139. As a result, a scraper bowl such as bowl 18 filled with loading apparatus 130 may include material that is relatively smaller in particle, size in one, part of the bowl, and relatively larger in particle size in a different part of the bowl. To optimally sort work material using loading apparatus 130, in one embodiment it may be configured via a relatively more horizontal inclination to discharge material in a smaller to larger size gradient from a front toward a back, respectively, of the subject bowl. Thus, during unloading, an operator may dispense partial loads at different parts of a work site, or in different layers on a given work surface, the partial loads having different average particle sizes.

INDUSTRIAL APPLICABILITY

Referring to the drawing Figures generally, during a typical loading operation, machine 10 will be driven across a work surface at as first work area, and cutter 20 and hence cutting edge 22 lowered to a desired vertical position such that cutting edge 22 will pass through work material, dislodging material from the work surface. Continued forward motion of machine 10 will result in additional material dislodged by cutter 20 being pushed upward and backward from cutting edge 22 and into chute 39, capturing the work material and beginning to load the same. Prior to or upon beginning to move cutter 20 through the work material, rotation of augers 34*a* and 34*b* in first and second directions may be initiated. Because augers 34*a* and 34*b* will typically be counter-oriented, e.g. having respective "left-handed" and "right-handed" helical configurations, they will typically be rotated in opposite directions during loading of bowl 18, but each urging work material in approximately the same feed direction, toward bowl 18 from cutter 20.

Work material pushed upward and rearward toward and into chute 38 will typically flow generally in two paths defined by curving surfaces 39*a* and 39*b* toward left and right sides of material feed opening 42. Approximately one half of the work material captured via cutter 20 will generally be fed toward first auger 34*a*, and one half fed toward second auger 34*b*. At material feed opening 42, rotation of augers 34*a* and 34*b* will generally rotate a cutting edge 53*a* and 53*b* at the loading ends 37 of each respective auger 34*a* and 34*b* against work material, and the work material will begin being conveyed through the portion of chute 38 defined by peripheral walls 50. Conveying of work material with augers 34*a* and 34*b* will tend to reduce the power necessary to continue to move machine 10 forward through the work material as compared to certain other designs. In particular, rotation of augers 34*a* and 34*b* performs a substantial portion of the loading work, rather than relying solely or mostly upon forward motion of the machine to push the work material into bowl 18.

When bowl 18 is relatively empty, work material will tend to be discharged via a portion of material discharge opening 36 that is located relatively close to front side 29 and bottom side 28 of bowl 18. As filling of bowl 18 progresses, material discharge opening 36 will tend to become partially blocked by deposited work material, and additional work material will be discharged relatively more upward and backward in bowl 18. This phenomenon results at least in part from the relative positioning of loading apparatus 30 in front of bowl 18, and its relative inclination. In one embodiment, the axis of rotation A of augers 34*a* and 34*b* may be oriented diagonally, for example at approximately a 45° angle, relative to articulation axis J. It is contemplated that an angle of approximately 45° may provide a desired balance between upward lifting force and backward loading force on work material conveyed by loading apparatus 30. For certain applications, and for certain machine designs, a different angle of inclination of axis A relative to axis J may be appropriate, and the augers may not be oriented in parallel. Where bowl load volume is to be maximized for a particular machine design or size, a loading apparatus 30 may be configured such that augers 34*a* and 34*b* are relatively more vertical, whereas when available power for pushing work material backward in bowl 18 is sought to be maximized, for example, for a relatively less powerful or lighter machine, a relatively more horizontal inclination of axis A may be appropriate.

When bowl 18 has been filled to a desired extent, cutter 20 may be lifted to substantially close bowl 18, and machine 10 will typically be driven to a second work area, for example, where work material is to be deposited. To deposit work material, cutter 20 may be lowered to a height corresponding to a desired lift thickness for deposited material. Machine 10 may then be driven across a work surface at the second work area, and augers 34*a* and 34*b* rotated in opposite directions to those used for loading bowl 18, to convey work material from bowl 18, through chute 38, and onto the work surface. During deposition of work material with machine 10, ejector apparatus 24 may be used to push work material toward front side 29 of bowl 18. Unloading of bowl 18 may thus take place in a manner generally the reverse of that occurring during loading. In other words, when bowl 18 is at least partially filled, work material may block a portion of material discharge opening 36, and thus material initially discharged via material discharge opening 36 will tend to be material that is positioned at relatively higher vertical positions in bowl 18. As unloading progresses, work material that is positioned progressively lower in bowl 18 will be discharged.

The presently disclosed design for a loading apparatus 30, 130 for use in a scraper or other material capturing machine 10 improves operating efficiency over known designs such as open bowl scrapers and auger scrapers wherein the augers are positioned within the bowl and thus reduce potentially available bowl volume. Rather than distributing work material within the bowl as in conventional auger-scraper designs such as Carston, augers 34*a* and 34*b* are used to convey work material into and out of the bowl without sacrificing bowl volume. This approach also allows easier loading, as the conveying power provided by augers 34*a* and 34*b* reduces the force necessary to move material into the bowl. Augers 34*a* and 34*b* can also carry material relatively higher into the bowl than conventional designs, as they do not have to overcome remolding forces associated with surrounding work material. In other words, in a design such as Carston, work material once distributed by the auger will tend to move back around the auger as bowl filling progresses, resisting efforts to pile material higher in the bowl, and also providing resistance to rotation of the auger.

With regard to conventional elevator scrapers, the present disclosure provides still other advantages. The present disclosure provides a system wherein the work material is better confined during conveying to the bowl, and may thus produce less airborne dust than elevator scraper systems. Moreover, expense, complexity and maintenance problems associated with elevator scraper designs are obviated, as machine 10 and loading apparatus 30, 130 may use a relatively smaller number of parts than elevator scrapers having track or chain driven paddles and the like.

The present description is for illustrative purposes only, and should not be construed to narrow the breadth of the present disclosure in any way. Thus, those skilled in the art will appreciate that various modifications might be made to the presently disclosed embodiments without departing from the full and fair scope of the present disclosure. For example, while the present disclosure is discussed primarily in the context of mobile scraper machines, it is not thereby limited. Those skilled in the art will appreciate that other types of material capturing and/or transfer apparatus such as are used in mining, agriculture and other activities may benefit from the teachings of the present disclosure. It should also be appreciated that while material discharge opening 36 is shown as an elongate, generally rectangular opening, and openings 136 are shown as spaced apart squares, the present disclosure is not thereby limited and slots, circular openings or some other configuration or positioning might be used. Other aspects, features and advantages will be apparent upon an examination of the attached drawings and appended claims.

What is claimed is:

1. A machine comprising:

a frame;

a bowl mounted to said frame, said bowl defining a load volume and including a front side, a back side, a lower side and first and second lateral sides;

a cutter coupled with said frame and having a cutting edge;

a loading apparatus positioned at the front side of the bowl, said loading apparatus being coupled with said cutter and comprising a chute that includes a first end disposed outside of said bowl, and a second end, said chute further including a material feed opening, an apron extending from the material feed opening toward the cutter and an inner peripheral wall connected with the apron and defining a floor wherein a plurality of differently sized material discharge openings are disposed;

said loading apparatus further including an auger disposed at least partially within said chute and including a first auger end, a second auger end and an axis of rotation, wherein the inner peripheral wall extends about the axis of rotation and encloses a longitudinal segment of the auger between the first auger end and the second auger end, the auger further being configured to move work material between the first and second ends of said chute; and an ejector positioned at the back side of the bowl and being movable toward the front side of the bowl to push work material toward the front side of the bowl for unloading via the chute.

2. The machine of claim 1 wherein said auger being configured to move work material in a feed direction through the chute which is generally aligned with its axis of rotation.

3. The machine of claim 2 wherein said apron includes a concave portion configured to guide work material toward said material feed opening.

4. The machine of claim 3 wherein the concave portion of said apron comprises a curved portion.

5. The machine of claim 2 wherein said auger comprises a first auger, said loading apparatus further comprising a second auger.

6. The machine of claim 5 wherein said first and second augers define a length dimension, and wherein said chute comprises curving inner peripheral walls extending about said first and second augers for at least a portion of said length dimension between said material feed opening and said plurality of differently sized material discharge openings.

7. The machine of claim 6 wherein said first and second augers comprise first and second auger blades defining overlapping first and second auger peripheries, respectively.

8. The machine of claim 7 wherein said bowl defines a bowl width, and wherein the inner peripheral walls of said chute define an internal chute width that is less than said bowl width but greater than about one half of said bowl width.

9. The machine of claim 8 wherein at least one of said plurality of differently sized material discharge openings is closest to the apron and is smaller than at least one other of said plurality of differently sized material discharge openings that is farthest from the apron.

10. The machine of claim 5 wherein the floor of said chute at least in part defining the front side of said bowl.

11. The machine of claim 10 wherein said frame comprises an articulated frame having a front unit and a back unit coupled together at a pivotable joint, said first and second augers each having an axis of rotation oriented diagonally relative to a vertical line passing through said pivotable joint.

12. A loading apparatus for a scraper machine comprising:

at least one auger having an axis of rotation, said at least one auger including a loading end and a second end opposite said loading end, and defining a length dimension aligned with said axis of rotation and extending between said loading end and said second end; and a chute including a material feed opening at a first position relative to the length dimension of said at least one auger, and including an inner peripheral wall defining a plurality of differently sized material discharge openings separate from said material feed opening and disposed at a second position relative to said length dimension which is different from the first position;

an apron extending from the material feed opening and connected with the inner peripheral wall, the inner peripheral wall extending about the axis of rotation and enclosing a longitudinal segment of the at least one auger between the loading end and the second end;

wherein said at least one auger is configured to move work material between said material feed opening and said discharge opening in a feed direction aligned generally with said axis of rotation an ejector positioned at the back side of the bowl and being movable toward the front side of the bowl to push work material toward the front side of the bowl for unloading via the chute.

13. The loading apparatus of claim 12 wherein said at least one auger comprises first and second counter-rotating augers oriented in parallel.

14. The loading apparatus of claim 13 wherein said apron including a concave portion.

15. The loading apparatus of claim 14 wherein said chute includes curving peripheral walls extending at least partially about each of said first and second augers, said apron including first and second concave portions connecting with said curving peripheral walls at said material feed opening.

16. The loading apparatus of claim 12 wherein at least one of said plurality of differently sized material discharge openings is closest to the apron and is smaller than at least one other of said plurality of differently sized material discharge openings that is farthest from the apron.

17. A method of operating a scraper machine comprising the steps of:

capturing work material at least in part via a step of moving a cutting edge of the scraper machine through the work material;

moving work material into a chute of the scraper machine at least in part via the moving step;

conveying work material from the chute to a bowl at least in part by rotating an auger disposed at least partially within the chute in a first direction of rotation about an axis positioned at an angle of inclination relative to a vertical line passing through a frame of the scraper machine, and at least in part by discharging work material into the bowl through a plurality of differently sized material discharge openings located in a floor of the chute; and conveying work material from the bowl to the chute at least in part by rotating the auger in an opposite direction of rotation with the axis positioned at the angle of inclination, and pushing work material toward the loading apparatus via a movable ejector positioned at a back side of the bowl.

18. The method of claim 17 wherein the auger comprises a first auger, the step of conveying work material further comprising conveying work material in part by rotating a second auger also disposed at least partially within the chute.

19. The method of claim 18 wherein rotating the first and second augers comprises rotating the first auger in a first direction, and rotating the second auger in a second, opposite, direction, and wherein conveying work material from the bowl to the chute further includes rotating the first and second augers in directions reverse to the first and second directions, respectively, and distributing the work material onto a work surface.

* * * * *